US006189261B1

(12) United States Patent
Helgeson

(10) Patent No.: US 6,189,261 B1
(45) Date of Patent: Feb. 20, 2001

(54) FLEXIBLE FLORAL ARRANGING GRID

(76) Inventor: Valerie A. Helgeson, 3593 Sunnygale Ct., San Jose, CA (US) 95117

( * ) Notice: Under 35 U.S.C. 154(b), the term of this patent shall be extended for 0 days.

(21) Appl. No.: 09/283,930

(22) Filed: Apr. 1, 1999

(51) Int. Cl.[7] ..... A47G 7/07
(52) U.S. Cl. ..... 47/41.11; 47/41.01
(58) Field of Search ..... 47/41.11, 41.01

(56) References Cited

U.S. PATENT DOCUMENTS

| | | | | |
|---|---|---|---|---|
| 1,260,042 | * | 3/1918 | Pullman | 47/41.11 |
| 1,491,926 | * | 4/1924 | Rosenwald | 47/41.11 |
| 1,562,992 | * | 4/1925 | Schling | 47/41.11 |
| 1,973,868 | * | 9/1934 | Field . | |
| 2,126,766 | * | 8/1938 | Gerbermann | 47/41.01 |
| 2,193,727 | * | 3/1940 | Jouffray . | |
| 2,900,760 | * | 8/1959 | Tupper . | |
| 3,170,875 | * | 2/1965 | Swett . | |
| 3,447,262 | | 6/1969 | Uhl . | |
| 3,457,673 | | 7/1969 | Shupe et al. . | |
| 3,760,460 | * | 9/1973 | Myers | 47/41.01 |
| 4,331,721 | * | 5/1982 | Ayers | 428/23 |
| 4,958,461 | | 9/1990 | Aldrich . | |
| 4,964,237 | | 10/1990 | Specht . | |
| 5,127,184 | | 7/1992 | Cosentino . | |
| 5,142,820 | | 9/1992 | Aquino . | |
| 5,347,752 | * | 9/1994 | Black | 47/41.11 |
| 5,375,370 | | 12/1994 | Zimmerman . | |
| 5,477,637 | * | 12/1995 | Aldrich | 47/41.01 |
| 5,758,452 | * | 6/1998 | Matteucci et al. | 47/41.11 X |

FOREIGN PATENT DOCUMENTS

| | | | |
|---|---|---|---|
| 694275 | * | 1/1996 | (EP) . |
| 2626158 | * | 7/1989 | (FR) . |

* cited by examiner

*Primary Examiner*—Michael J. Carone
*Assistant Examiner*—Jeffrey L. Gellner
(74) *Attorney, Agent, or Firm*—James G. O'Neill

(57) ABSTRACT

A flexible grid for use in guiding a person to arrange flowers, and the like, includes a number of openings formed therein by woven-together fluffy fabric-coated, flexible wires. The flexible grid may be supported on, as by being bent around, or in an open top of a container to enable a number of different size floral stems to be inserted and frictionally held in the openings. The floral stems and the flexible grid may be removed as a unit from the open top of the container to enable the lower ends of the floral stems to be snipped for better water absorption, or to add water to the container.

12 Claims, 2 Drawing Sheets

FLEXIBLE FLORAL ARRANGING GRID

BACKGROUND OF THE INVENTION

1. Field of the Invention

This invention relates generally to floral arranging devices, and, more particularly, to a flexible floral arranging grid for placement on top of a vase, or the like.

2. Description of Related Art

As is well known, a novice in the art of floral arrangements must struggle or ask for help when arranging flowers in a vase or another container, so as to offer a symmetrical and pleasing arrangement. Many types of devices have been proposed to aid both the novice and the professional in arranging flowers and other items in a pleasing and artistic arrangement. Examples of prior art devices are shown in U.S. Pat. No. 3,447,262 to Uhl, U.S. Pat. No. 3,457,673 to Shupe et al., U.S. Pat. No. 4,958,461 to Aldrich, U.S. Pat. No. 4,964,237 to Specht, U.S. Pat. No. 5,127,184 to Cosentino, and U.S. Pat. No. 5,142,820 to Aquino. These known devices include non-flexible domes or grids, flower foam, bucket lids with a number of openings therein to hold bouquets of flowers, pliable layers over openings and a cantilever workholder having a support with removable, flexible lines held taught therein.

In particular, the '262 patent to Uhl includes a non-flexible grid having an outer annular rim which is positioned over and affixed to an associated container so as to be secured in place on the container when a floral arrangement is placed within the grid. This device, however, is not flexible and is not adapted to be used with containers, other than the container for which it is specifically designed.

While the prior art devices disclosed in the above-mentioned patents provide improvements in the art, there still exists a need in the art for a simple, less costly and easy-to-use, flexible and adjustable device which can be used by an expert and/or a novice to easily complete a floral arrangement in place on a vase, or the like, and which may also be used to hold the arrangement in place while changing water, and remove the floral arrangement from a container, to enable the ends of the stems of the arrangement to be snipped for better water absorption.

SUMMARY OF THE INVENTION

Accordingly, it is a general object of the present invention to provide an improved and simplified floral arrangement device. It is a particular object of the present invention to provide an improved flexible floral arranging device. It is another particular object of the present invention to provide an improved flexible floral arranging device which provides symmetrical guides and support for individual flower stems no matter what their size. It is yet another particular object of the present invention to provide an improved flexible floral arranging device in the form of a grid, which will hold a floral arrangement in place when removed from a vase, or when changing water. And, it is still another particular object of the present invention to provide an improved floral arranging device having a flexible grid formed from flexible elements having a soft outer coating which accommodates different sized floral stems, and both holds and supports the same in position within a container, or when removed from the container.

These and other objects and advantages of the present invention are achieved by providing a flexible grid arrangement constructed from a plurality of flexible individual elements having a soft or fluffy outer coating which protects delicate stems and holds them in place by friction. The improved device of the present invention is adapted to be bent over, or to be supported in the open top of different size containers. The device of the present invention is also useful when removing an arranged floral bouquet from a container to keep the bouquet intact so that the ends of stems held therein may be snipped for better water absorption, and to keep the arrangement in place when adding or changing water.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, wherein:

DESCRIPTION OF THE PREFERRED EMBODIMENTS

The following description is provided to enable any person skilled in the art to make and use the invention and sets forth the best modes contemplated by the inventor of carrying out her invention. Various modifications, however, will remain readily apparent to those skilled in the art, since the generic principles of the present invention have been defined herein specifically to provide for a novel and improved and simplified flexible grid flower arrangement device 10 shown as being circular, but which could take any shape, such as square, rectangular or any other desired shape. The device 10 is for use in holding a floral arrangement in a pleasing pattern, and for placement over or in an open top 14 of a container 12. Preferably, the device 10 covers as by being bent over the top edge, or is supported on the open top 14 of the container 12, to allow a plurality of items 16, 18, such as flowers, decorative greens, or the like, to be inserted and securely held therein, in an aesthetically pleasing manner, as explained more fully below.

Figure 1:
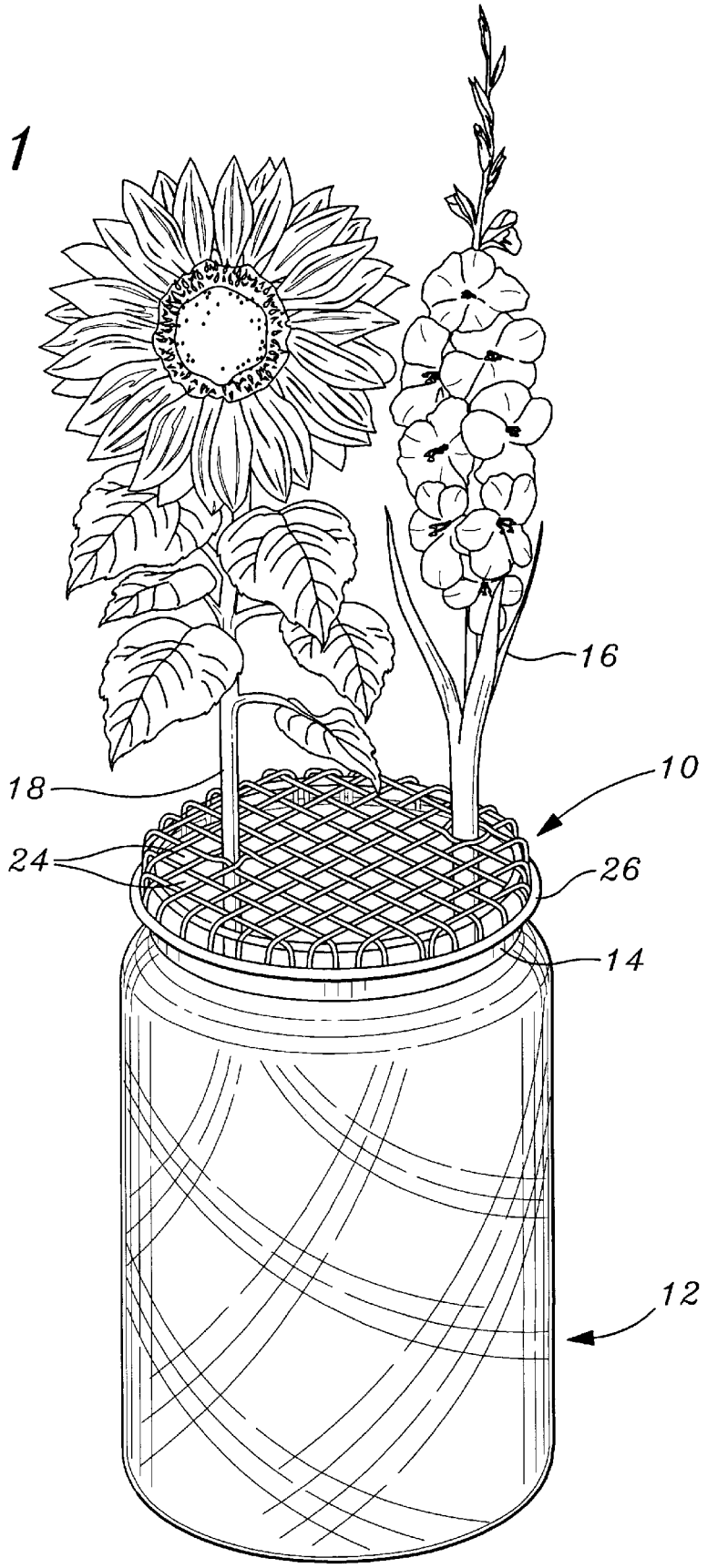
FIG. 1 is an isometric view of a vase or container having an improved flexible grid of the present invention placed thereon and supporting flowers having different size stems therein.
Figure 2:
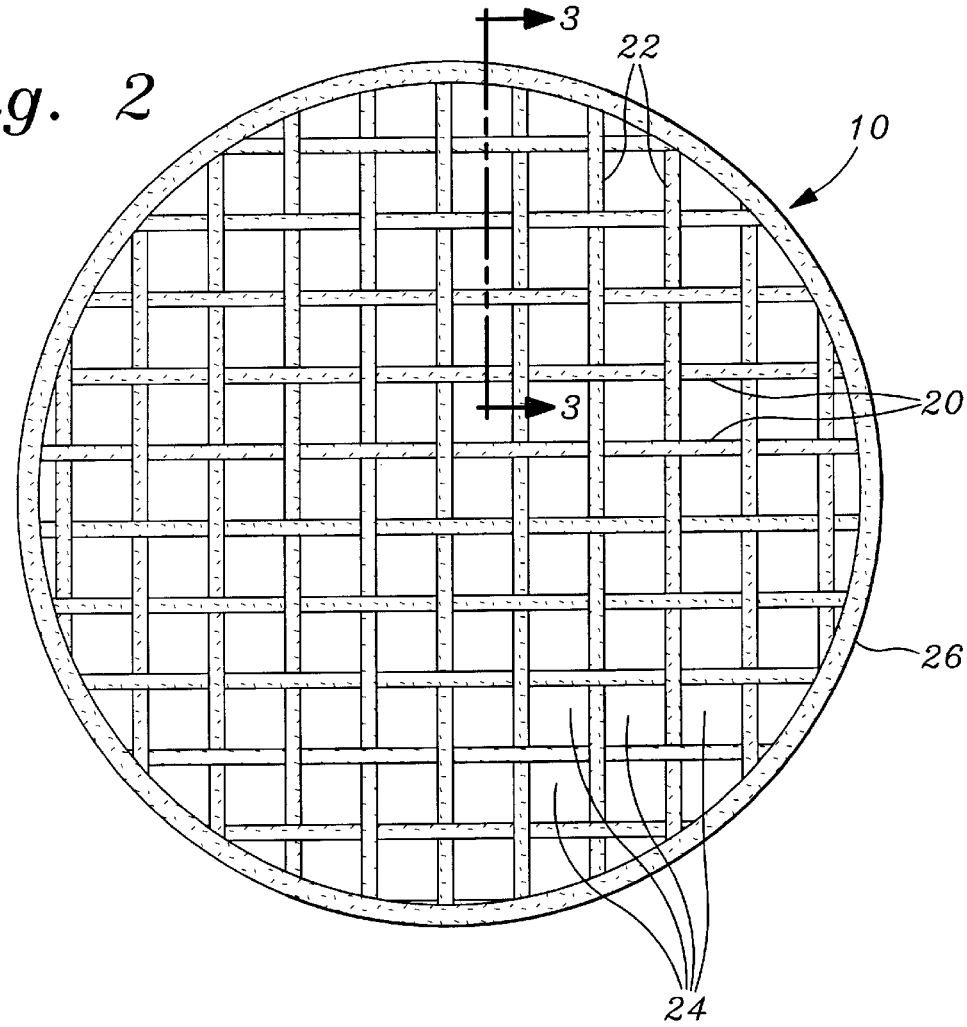
FIG. 2 is a top elevational view of the improved flexible grid of the present invention.
Figure 3:
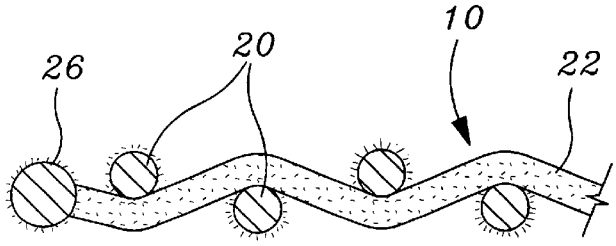
FIG. 3 is a cross-sectional view of the grid of FIG. 2 taken along line 3—3.

As best shown in FIGS. 2 and 3, the grid 10 is formed from a plurality of flexible horizontal and vertical members 20, 22, which are woven or otherwise held together so as to form a flexible device with flexible openings 24. The openings 24 are adapted to accommodate different size stems of fresh, dried or silk flowers, or the like, inserted therein, either by stretching or being pinched together. The outer periphery of the grid 10 is provided with a flexible holding or securing portion 26, also woven or otherwise held to the horizontal and vertical members 20, 22. As best shown in FIG. 1, when an enlarged stem of a flower, or the like, 16, is inserted in a flexible opening 24, the side edges 20, 22 thereof will stretch or be bent so as to accommodate the stem, and hold it in place. Although any type of flexible material can be used, it has been found that a wire with a fluffy or soft fabric-coating, such as a pipe cleaner, may be used to form the grid. The exterior soft or fluffy, fabric coating protects delicate stems from damage, and also frictionally holds the stems in position. Additionally, if a narrow stem, such as 18, is inserted in one or more of the openings 24, and it is desired to firmly hold that narrow stem in place, the sides 20, 22 of the opening 24 may be pinched or otherwise bent inwardly to firmly secure the smaller stem in place. Also, as shown in FIG. 1, the flexible outer periphery of the grid 10 is bent, fitted, or otherwise adjusted over the rim of the vase 12.

It therefore, can be seen that the preferred embodiment of the flexible grid 10 of the present invention may be bent over, placed on, or supported in the open top of any size or shaped container, such as a vase, and enable a novice or expert to easily arrange a symmetrical floral bouquet by insertion of individual items in the openings 24 of the grid. Since the flexible elements of the grid of the present invention are adapted to frictionally fit and hold stems in position, the entire grid and the floral arrangement held therein may be removed from the container on or in which it is placed, so that water may be added or changed, or the ends of the flower stems may be snipped for better water absorption, thereby extending the life of the flowers. The flexible grid of the present invention may be dyed or otherwise made in different colors to match various vases and/or the floral arrangements held therein, and may be rinsed and reused many times. Or, if desired, the flexible grid 10 may be replaced by a new grid each time a different floral arrangement is made.

Those skilled in the art will appreciate that various adaptations and modifications of the just-described preferred embodiments can be configured without departing from the scope and spirit of the invention. Therefore, it is to be understood that, within the scope of the appended claims, the invention may be practiced other than as specifically described herein.

What is claimed is:

1. A reusable floral arranging device for facilitating an arrangement of cut flowers, or the like, comprising, in combination:

a container having an open mouth;

a substantially circular-shaped body having a plurality of flexible members secured together to form a grid; the body being removably held on the container over the open-mouth;

the substantially circular-shaped body having a rim portion surrounding and secured to the plurality of flexible members; the rim portion being bent over an edge of the open-mouth container to removably hold the substantially circular-shaped body to the container; and the plurality of flexible members and rim portion forming a plurality of flexible openings within the grid; the plurality of flexible openings have horizontal and vertical sides; the horizontal and vertical sides being adjustable to firmly hold different size stems in the grid over the open mouth.

2. The reusable floral arranging device of claim 1 wherein the plurality of flexible members include soft outer surfaces to frictionally hold the different size stems placed in the plurality of flexible openings.

3. The reusable floral arrangement device of claim 2 wherein the plurality of flexible members are woven together.

4. The reusable floral arrangement device of claim 3 wherein the rim portion is woven up to the plurality of flexible members.

5. The reusable floral arrangement device of claim 4 wherein the soft outer surfaces are a fluffy fabric.

6. The reusable floral arrangement device of claim 5 wherein the plurality of flexible members are made from wire, coated with the fluffy fabric.

7. The reusable floral arrangement device of claim 1 wherein the plurality of flexible members and rim portion include soft outer surfaces to frictionally hold stems placed in the plurality of flexible openings.

8. The reusable floral arrangement device of claim 7 wherein the plurality of flexible members and rim portion are made from wire having a fluffy fabric coating.

9. The reusable floral arrangement device of claim 8 wherein the body of the floral arrangement device is substantially circular in shape, and the rim portion is bent over an edge of the open-mouth to removably hold the body to the container.

10. A reusable floral arranging device for facilitating a symmetrical arrangement of cut flowers, or the like, comprising, in combination:

a floral container having an open-mouth;

a body having a plurality of flexible members woven together to form a grid having a plurality of flexible openings therein;

an outer rim surrounding the body and woven to the plurality of flexible members;

the plurality of flexible openings including flexible horizontal and vertical sides which horizontal and vertical sides are adjustable to frictionally hold different size floral stem therein; and the plurality of flexible members and the outer rim being made from flexible wires having a soft outer coating.

11. The reusable floral arranging device of claim 10 wherein the soft outer coating is a fluffy fabric, the body is substantially circular in shape, and the outer rim is bent to conform to fit over and be removably held on an edge of the open-mouth.

12. The floral arranging device of claim 10 wherein the soft outer coating is a fluffy fabric secured to the flexible wires.

* * * * *